United States Patent [19]

Terry, III

[11] Patent Number: 4,955,313

[45] Date of Patent: Sep. 11, 1990

[54] HEIGHT-ADJUSTABLE ROOF FOR A PILOT HOUSE/HELM STATION

[76] Inventor: Alfred E. Terry, III, 79th St. Boat Basin, New York, N.Y. 10024

[21] Appl. No.: 374,878

[22] Filed: Jul. 3, 1989

[51] Int. Cl.[5] ..... B63B 29/02

[52] U.S. Cl. ..... 114/361; 114/71

[58] Field of Search ..... 114/361, 71, 65 R, 343

[56] References Cited

U.S. PATENT DOCUMENTS

| | | | |
|---|---|---|---|
| 2,714,387 | 8/1955 | Meldrum | 114/361 |
| 3,165,762 | 1/1965 | Hage | 114/361 |
| 3,797,436 | 3/1974 | Moore | 114/361 |
| 3,805,724 | 4/1974 | Butler | 114/361 |

OTHER PUBLICATIONS

Carver, 1985 catalog, 10/18/86, Pulaski, WI, 28 Riviera Aft Cabin.

*Primary Examiner*—Sherman Basinger
*Assistant Examiner*—Stephen P. Avila
*Attorney, Agent, or Firm*—Milton S. Gerstein

[57] ABSTRACT

A helm-station/pilot-house for a boat in which there is provided a vertically-slidable roof slidably mounted with respect to, and supported by, the radar arch of the helm-station/pilot house. The roof may be raised to its elevated position during sunny weather, and lowered to its downward-most state during rainy weather.

19 Claims, 2 Drawing Sheets

HEIGHT-ADJUSTABLE ROOF FOR A PILOT HOUSE/HELM STATION

BACKGROUND OF THE INVENTION

The present invention is directed to a vertically-movable roof for a pilot house or helm station of a boat in order to vary the height of the roof, so that during inclement weather, the roof may be lowered and the control-compartment closed, or may be elevated during sunny or warm weather where the compartment is open to the ambient surrounding. Helm stations for relatively large boats, as yachts, is the compartment where controls for the boat are located, are generally and conventionally provided with an elevated roof raised above the remainder of the control compartment, thus providing an open space between the interior of the compartment and the outside. Typically, when one desires to close off such opening to the outside, a canvas or other type of enclosure is wrapped about the open space between the bottom of the elevated roof and the upper surfaces of the compartment side walls and front wall or wind shield, or the like. Such enclosure may be snapped into place, or otherwise removably secured. Smaller boats of the 11–30 feet range generally have a center console or pilot house without any general protective covering at all, as in a helm station. The present invention is as equally applicable to a pilot house a sit is to helm station, so as to define a new type of center control compartment for a smaller boat with the advantages of the helm station of a larger boat. Helm stations of large boats typically include a rear upstanding radar arch, which sometimes actually mounts radar, but usually is only an aesthetic appurtenance having remained even though its prior function as radar-equipment support has been made largely obsolete. Some of the helm stations above-referred to do utilize the upper surface of the radar arch to support a fixed roof at the rear, or for supporting protective but removable enclosure-canvas, or the like.

SUMMARY OF THE INVENTION

It is the primary objective of the present invention to provide a convertible helm-station that combines the advantages of all of the prior-art enclosures into a simple and but highly effective and easy to use convertible roof.

It is another objective of the present invention to provide a pilot house of smaller boats with the same general design of a convertible roof as for the helm-station.

It is yet another objective of the present invention to utilize the largely aesthetic radar arch for slidingly and adjustably supporting an adjustable roof.

Toward these and other ends, the convertible helm station or pilot house of the invention is provided with a roof that defines downwardly-extending braces that are adjustably positionable with respect to tracks mounted in the two interior side wall surfaces of a radar arch of a conventional helm station, or by providing such a radar arch for a pilot house for small boats. The roof is positionable at a plurality of different elevations for a desired height above the side walls and windshield of the compartment of the helm station or pilot house.

BRIEF DESCRIPTION OF THE INVENTION

The invention will be more readily understood with reference to the accompanying drawings, wherein.

DETAILED DESCRIPTION OF THE INVENTION

Figure 3:
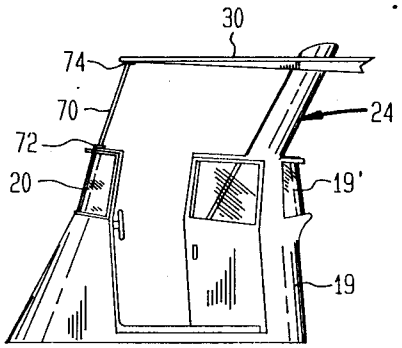
FIG. 3 is a side view thereof showing the roof in its elevated state.
Figure 5:
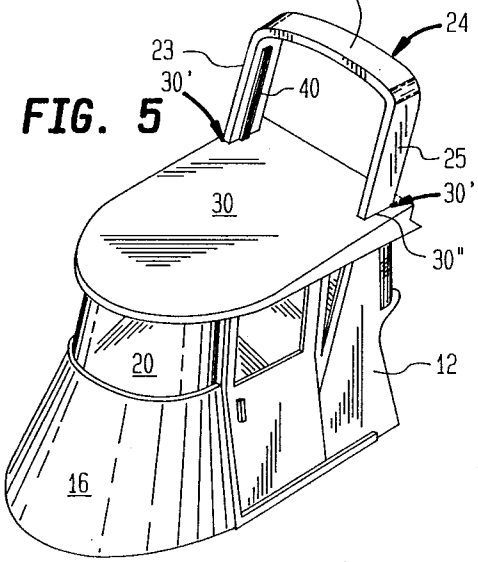
FIG. 5 is an isometric view thereof with the roof in its downward, protective state.
Figure 2:
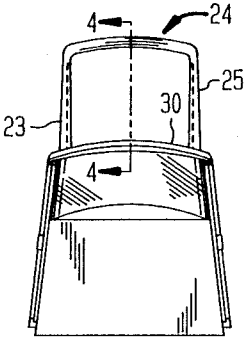
FIG. 2 is a rear view thereof.
Figure 1:
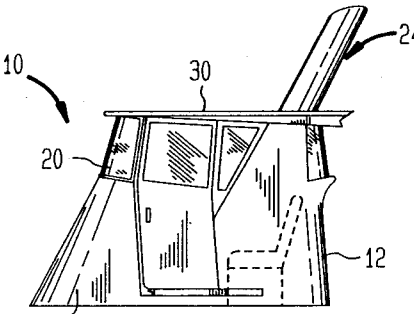
FIG. 1 is a side view of a helm-station or pilot house incorporating therein the height-adjustable roof of the invention.
Figure 4:
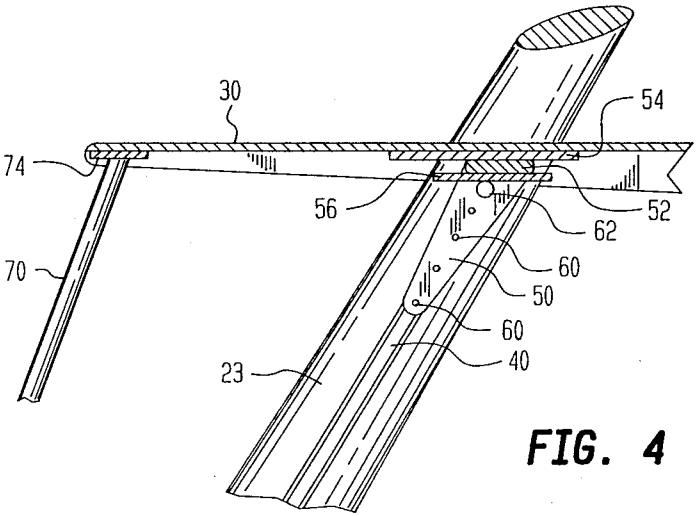
FIG. 4 is a cross-sectional side view showing the connection between the roof and radar arch.
Figure 8:
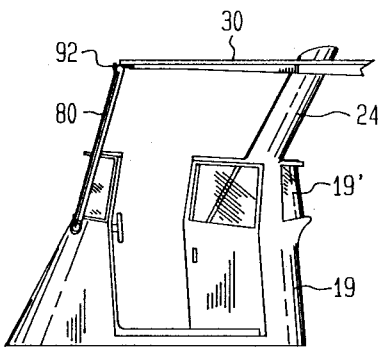
FIG. 8 is a side view showing the elevated state of the roof.
Figure 7:
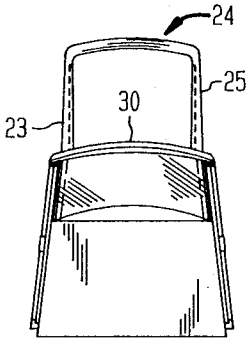
FIG. 7 is a rear view thereof.
Figure 6:
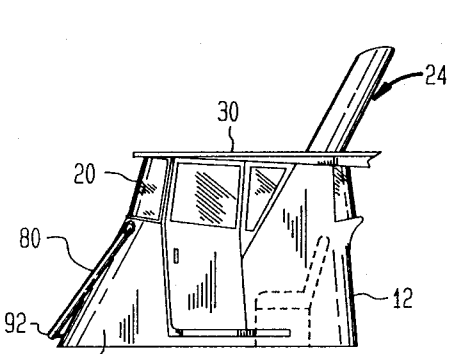
FIG. 6 is a side view showing a modification of the improved helm station or pilot house of the invention with the provision of a pivotal retaining loop for ensuring the elevated state of the roof.
Figure 11:
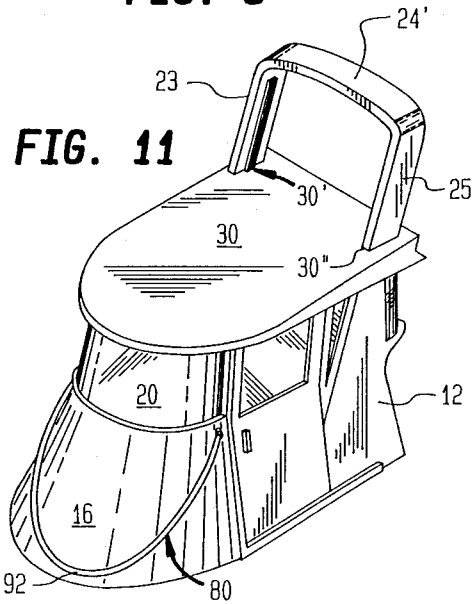
FIG. 11 is an isometric view thereof with the roof in its downward protective state.
Figure 10:
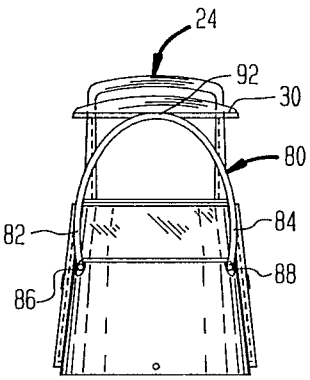
FIG. 10 is a front view thereof showing the roof in its elevated state.
Figure 9:
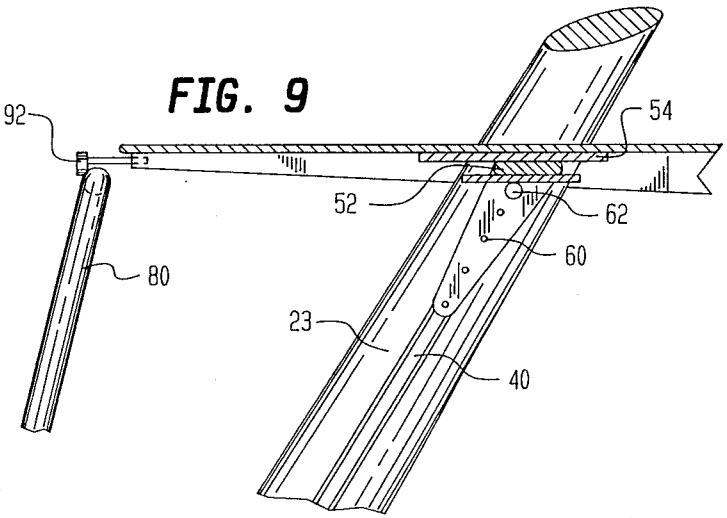
FIG. 9 is a cross-sectional view thereof similar to FIG. 4 and showing the engagement of the retaining loop with the forward end of the roof.

Referring now to the drawings in greater detail, and FIGS. 1–5, there is shown a helm-station, or pilot house, 10 for a boat. The helm station 10 of the invention includes a pair of side walls 12 in each of which is formed a sliding door 14 allowing access into and through the helm station enclosure. There is also provided a front wall 16 that curves for interconnecting the forward edges of the side walls, and a rear wall 19. A windshield 20 is provided on the upper edge of the front wall and curves similarly to it, and a rear windshield 19' is provided on the upper edge surface of the rear wall. Projecting upwardly from the top of the rear of the side walls, and formed integrally therewith, is a radar arch 24 that has an elevated, horizontal connecting arch-section 20'. The radar arch is generally an aesthetic appurtenance, though it is occasionally still used in its originally-intended capacity as a support for radar equipment. In the present invention, the radar arch proper has been given a new function: To wit, sliding support of a roof 30 of the helm station/pilot house so that the roof may be slid upwardly, as shown in FIG. 3, to allow access to the ambient surroundings for opening up the enclosure during sunny days, and the like, and closing off the enclosure during rainy days, and the like. The sliding mounting of the roof 30 is achieved, in the preferred embodiment, via a pair of slots or channels 30' formed in the rear of the roof 30 through which slots are received the pair of side beams or braces 23, 25 of the radar arch 24, so that the roof 30 proper may be guided therealong. The upper limit of the movement of the roof 30 is defined by the arch 24' of the radar arch, while the lower limit of movement is defined by the upper edges of the side walls 12. Each of the side beams or braces 23, 25 is provided with an interior-facing track 40 on the inner surface thereof. Each track is provided, in the preferred embodiment, with a plurality of linearly-aligned holes extending along a certain length thereof, which holes are used for variably positioning the roof at a desired height above the upper edges of the side walls of the helm station compartment. The interior-facing, or lower surface face, of the roof 30 is provided with a pair of oppositely-disposed, downwardly-projecting bracket-arms 50, one on each lateral side of the roof, the two bracket-arms 50 being interconnected by a transversely-extending, cross-support member 52 fixedly secured to the underside of the roof. A pair of sandwiching support struts 54, 56 may also provided for additional structural integrity. Each bracket-arm 50 is provided with a series of linear-aligned holes 60 for matching with the holes formed in the respective track 40, so that one or more holes 60 can be aligned with one or more holes of the respective track 40 for securing the roof at the desired elevation via bolts 62. Each bracket-arm 50 projects downwardly at an acute angle with respect to the horizontal roof 30 to accomodate the rearwardly sloped radar arch 24 and rearwardly sloped side rails 23, 25 and tracks 40 thereof. Of course, the radar arch 24 may have no slope at all, but may be vertically oriented only, or even have a forward-sloping incline. The openings 30' of the roof also are made to accomodate such rearward incline of the radar arch, with the interior surfaces of the slot thereof being appropriately canted at the same sloping angle to accomodate the sliding interconnection therebetween, and to also provide as tight a fit as possible for protecting the interior of the enclosure from ambient conditions when the roof is in its downward-most position. Appropriate and conventional gaskets 30" may be used for sealing the connections therebetween. It is also desired to allow for the removal of the arch portion 24' from the side braces 23, 25, so that if it is desired to completely remove the roof 30, such is possible. Thus, the arch portion 24' may be removably secured to the upper surfaces of of the side braces 23, 25 as by brackets and screws, and the like, to allow for such removal. The lines 70, 72 in FIG. 5 indicate such removable coupling. In the raised state of the roof 30, there is also provided a forward support bar 70, which is removably and manually positioned between two reinforced bearing surfaces 72, 74, formed in the upper surface of the forward part of the windshield 20 and bottom surface of the forward portion of the roof 30, respectively, so as to support the forward portion of the roof in its raised state, as shown in FIGS. 3 and 4. The bar or rod 70 may be made upwardly tapering so as to be narrower on top as on the bottom, so that the upper bearing support 74 may be telescoped into the lower support 72 when the roof is in its downward-most state, where, in combination with a recessed bearing support 72, a tight enclosure is formed when the roof is in its lowered state.

A slightly modified form of the invention is shown in FIGS. 6–11, where like parts are indicated by like reference numerals. In this modification, the bar 70 has been replaced with a U-shaped, pivotal, partial loop-member 80 pivotally secured at its two ends 82, 84 to the upper forward surface of the front wall 16 via pivot connections 86, 88. The partial securing loop 80 has a central portion 90 that cooperates with a loop-contact member 92, which may be a bolt, or the like, the shaft portion of which rests upon the member 90. Of course, any contact-member 92 could be used that will prevent the accidental and unwanted removal of the loop-member 80 from under the roof.

While a specific embodiment of the invention has been shown and described, it is to be understood that numerous changes and modifications may be made therein without departing from the scope, spirit and intent of the invention as set forth in the appended claims. For example, the roof may be lowered and raised using a winch, or using a power cylinder, and the like, instead of the manual approach above-described.

What I claim is:

1. A helm station/pilot house for a boat, comprising:

a front wall, pair of side walls, and a rear wall coupled together to form a protective enclosure, each said wall defining an upper edge surface;

a radar arch projecting upwardly from at least the upper edge surface of one of said pair of side walls and said rear wall, said radar arch comprising a first upstanding side post projecting upwardly from one lateral side of said enclosure, and a second upstanding side post projecting upwardly from the other lateral side of said enclosure, and a cross member interconnecting the upper edge surfaces of said first and second side posts;

a slidably adjustable roof operatively coupled to said first and second upstanding side posts of said radar arch, said roof having a pair of laterally spaced-apart openings through which project said first and second upstanding side posts, whereby said roof is slidable with respect to said first and second upstanding side posts ; and means for selectively and releasably retaining said roof at at least one elevated position positioned above said upper edge surfaces of said walls of said enclosure, whereby said roof may be elevated to expose the interior of the enclosure to the ambient surroundings.

2. The helm station/pilot house according to claim 1, wherein said means for retaining comprises a pair of downwardly-extending brackets projecting from laterally opposite sides of the interior-facing bottom surface of said roof, each said bracket comprising at least one hole formed therethrough; each said first and second upstanding side post of said radar arch comprising at least one cooperating opening on the interior-facing side surface thereof for mutual cooperation with said at least one hole of the respective said bracket; and a first and second means respectively passing through both said holes of a respective said bracket and said opening of a respective juxtapositioned said upstanding side post for retaining said roof in its elevated position.

3. The helm-station/pilot house according to claim 2, wherein each of said first and second means comprises a bolt.

4. The helm-station/pilot-house according to claim 2, wherein said means for retaining further comprises a transversely-extending cross-support member fixedly secured to said interior-facing bottom surface of said roof, said cross-support member comprising a pair of lateral ends and being integrally connected with said pair of downwardly-extending brackets at said lateral ends.

5. The helm-station/pilot-house according to claim 2, wherein each of said first and second side posts comprises a longitudinally-extending track extending along an upper portion of the length of the respective said post, said means for retaining being slidably receivable in said tracks.

6. The helm-station/pilot-house according to claim 1, wherein said means for retaining comprises a securing bar having a first lower end positionable on said upper edge surface of said front wall, and second upper end for supporting a portion of the bottom forward surface of said roof, whereby said roof is more fully secured in its elevated state.

7. The helm-station/pilot-house according to claim 1, wherein said means for retaining comprises an U-shaped partial loop having a first end and second end pivotally connected to said front wall, means for pivotally connecting said ends to said front wall, and means on the bottom forward surface of said roof for engaging a central section of said loop for preventing said loop from rotating, whereby said roof is safely secured in its elevated state.

8. The helm station/pilot house according to claim 7, wherein said means for retaining further comprises a pair of downwardly-extending brackets projecting from laterally opposite sides of the interior-facing bottom surface of said roof, each said bracket comprising at least one hole formed therethrough; each said first and second upstanding side posts of said radar arch comprising at least one cooperating opening on the interior-facing side surface thereof for mutual cooperation with said at least one hole of the respective said bracket, and a first and second means respectively passing through both said holes of a respective said bracket and said opening of a respective juxtapositioned said upstanding side post for retaining said roof in its elevated position.

9. The helm-station/pilot-house according to claim 8, wherein said means for retaining further comprises a transversely-extending cross-support member fixedly secured to said interior-facing bottom surface of said roof, said cross-support member comprising a pair of lateral ends and being integrally connected with said pair of downwardly-extending brackets at said lateral ends.

10. A helm station/pilot house for a boat, comprising:

a front wall, and pair of side walls coupled together to form an enclosure, each said wall defining an upper edge surface;

a radar arch projecting upwardly from the upper edge surfaces of said pair of side walls, said radar arch comprising a first upstanding side post projecting upwardly from one lateral side of said enclosure, and a second upstanding side post projecting upwardly from the other lateral side of said enclosure, and a cross member interconnecting the upper edge surfaces of said first and second side posts;

a slidably adjustable roof operatively coupled to said first and second upstanding said posts of said radar arch; means mounting said roof to said first and second upstanding side posts for relative, sliding movement of said roof with respect to said side posts; and means for selectively and releasably retaining said roof at at least one elevated position positioned above said upper edge surfaces of said walls of said enclosure, whereby said roof may be elevated to expose the interior of the enclosure to the ambient surroundings.

11. The helm-station/pilot house according to claim 10, wherein said front wall comprises an upstanding windshield, and at least one of said side walls comprising a door, said roof defining a lower surface resting upon said upper edge surfaces of said walls when said roof is in its lower-most position.

12. The helm-station/pilot-house according to claim 11, further comprising a rear wall connected to the rear edge surfaces of said pair of side walls.

13. The helm-station/pilot house according to claim 10, wherein said means for retaining comprising means for releasably securing said roof to the interior surfaces of said first and second posits of said radar arch.

14. A method of enclosing a helm-station/pilot house, which comprises at least a front wall and a pair of side walls, and a radar arch projecting upwardly from the pair of side walls, said radar arch having a pair of upstanding side posts and an upper cross-member spanning the tops of said side posts, said method comprising:

(a) mounting a roof to said side posts of said radar arch for relative sliding movement thereto;

(b) sliding the roof downwardly along said side posts of said radar arch to a closed state into contact with the upper edge surfaces of the pair of side walls and front wall;

(c) after said step (b), sliding the roof upwardly along said side posts into an elevated position where the roof is spaced upwardly from and out of contact with the upper edge surfaces of the front wall and side walls to expose the interior to the ambient air.

15. The method according to claim 14, wherein said step (c) comprises securing the roof to the side posts of the radar arch after having been raised to said elevated position.

16. The method according to claim 15, further comprising: (d) repeating said step (b) after said step (c).

17. The method according to claim 14, wherein said step (a) comprises forming two laterally-spaced apart through-openings in the roof, and inserting the two lateral side posts of the radar arch through the two through-openings.

18. The method according to claim 17, wherein said step (a) further comprises weather-sealing the two through-openings about the respective side post of the radar arch extending therethrough, so that rain, and the like, is prevented from entering the enclosure when the roof is in its down position.

19. The method according to claim 15, further comprising emplacing a support between the forward portion of the roof and the front wall for supporting the forward part of the roof when in its elevated position.

* * * * *